United States Patent [19]

Rentfrow

[11] 4,305,685

[45] Dec. 15, 1981

[54] QUICK RELEASE DIVERS BELT

[76] Inventor: Bruce A. Rentfrow, 7612 Pine Valley Dr., Sacramento, Calif. 95628

[21] Appl. No.: 74,557

[22] Filed: Sep. 7, 1979

[51] Int. Cl.[3] ..... B63C 11/02

[52] U.S. Cl. ..... 405/186; 2/309

[58] Field of Search ..... 405/186; 2/311, 309, 2/338, 2.1 R

[56] References Cited

U.S. PATENT DOCUMENTS

| | | | |
|---|---|---|---|
| 795,064 | 7/1905 | Reiter | 2/309 |
| 1,176,477 | 3/1916 | Meyerfeld | 2/309 |
| 1,345,917 | 7/1920 | Fitzgerald | 2/309 X |
| 3,053,318 | 9/1962 | Artman | 160/231 R |
| 3,090,205 | 5/1963 | Hurwitz et al. | 405/186 |
| 3,192,723 | 7/1965 | Apperson | 405/186 |
| 3,342,036 | 9/1967 | Gruget | 405/186 |

*Primary Examiner*—Dennis L. Taylor

*Attorney, Agent, or Firm*—Mark C. Jacobs

[57] ABSTRACT

A quick release diver's belt including a pair of flexible weighted arcuate sections interconnected by a releasable section to encircle the waist of a diver with the releasable section disposed at the back of the diver and the arcuate sections terminating in spaced free ends at the front of the waist of the diver to facilitate quick removal. The belt can be tightened by merely pushing in on the arcuate sections or be released by pulling one of the sections at the front of the diver away from the diver's body.

15 Claims, 7 Drawing Figures

QUICK RELEASE DIVERS BELT

BACKGROUND OF THE INVENTION

1. Field of the Invention

The invention relates to diver's belts; and, more particularly, to a diver's belt which can be tightened by pushing in, and released quickly at any body attitude with one hand and without accidental release of other diving equipment or apparatus.

2. Description of the Prior Art

Many types of diving belts are known in the art. Although some of these have means for varying the weight thereof, such weights usually cannot be quickly and easily added and shift position in use thus causing problems for the diver. Further, most such devices require a buckle or other fastener which results in the diver mistaking his belt for other gear when quick released, such as in an emergency, if desired.

These prior art devices cannot be easily released if the diver is entangled since they require both hands to be free, or a certain body attitude. They also require complex diver movements to tighten. Such tightening is always necessary since wet suits compress due to water pressure shrinking in the process which results in loosening of the belt. It must thus be tightened. There is a need for a diving belt which can be easily tightened but quickly and easily released with one hand at any body attitude.

SUMMARY OF THE INVENTION

It is an object of this invention to provide a buckleless weighted belt for a diver.

It is a further object of this invention to provide a weighted belt for a diver which can be tightened without fasteners and quickly released in any body attitude with only one hand.

It is still further an object of this invention to provide such a belt which can be released without the possibility of accidental release of the other diving gear and permits adding or subtracting non-shifting weights thereto.

These and other objects are preferably accomplished by providing a pair of flexible weighted arcuate sections interconnected by a releasable section to encircle the waist of a diver with the releasable section disposed at the back of the diver and the arcuate sections terminating in spaced free ends at the front of the waist of the diver to facilitate quick removal. The belt can be tightened by merely pushing in on the arcuate sections or be released by pulling one of the arcuate sections at the front of the diver away from the diver's body.

DESCRIPTION OF THE PREFERRED EMBODIMENT

Figure 1:
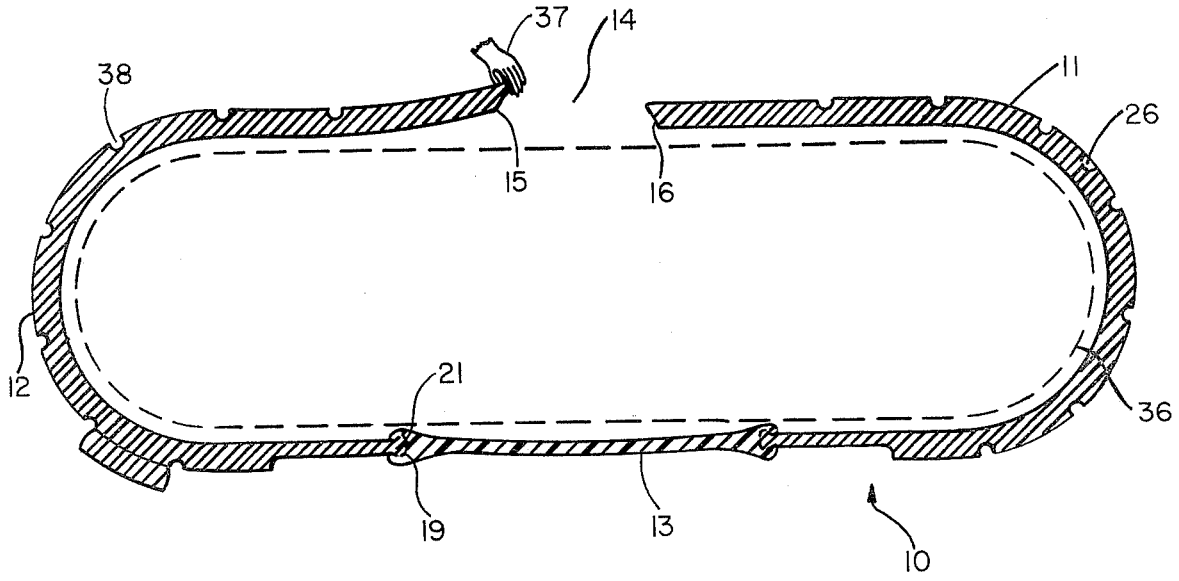
FIG. 1 is a top plan view of a diver's belt in accordance with the teachings of the invention.

Referring to FIG. 1 of the drawing, a diver's belt 10 is shown having three sections in accordance with the teachings of the invention. The belt 10 has a first section 11, which is arcuate and weighted, and a like second arcuate weighted section 12 and a third detachable section 13 interconnecting sections 11 and 12. Belt 10 is adapted to encircle a diver's body with section 13 at the back of the diver. As can be seen in FIG. 1, a space 14 is provided between ends 15,16 of sections 12,11, respectively.

Figure 2:
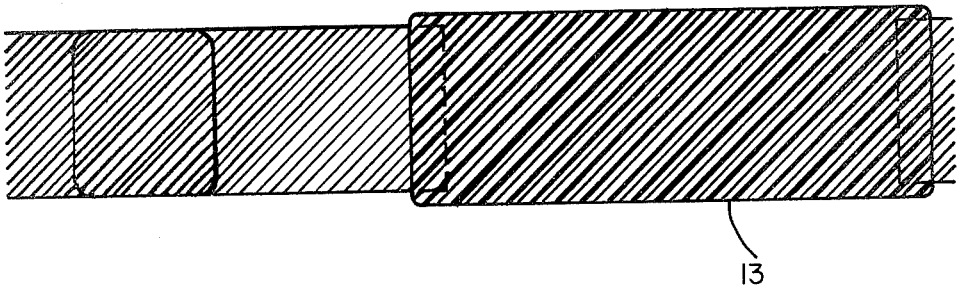
FIG. 2 is a detailed view of the belt of FIG. 1 taken along lines II—II thereof.
Figure 3:
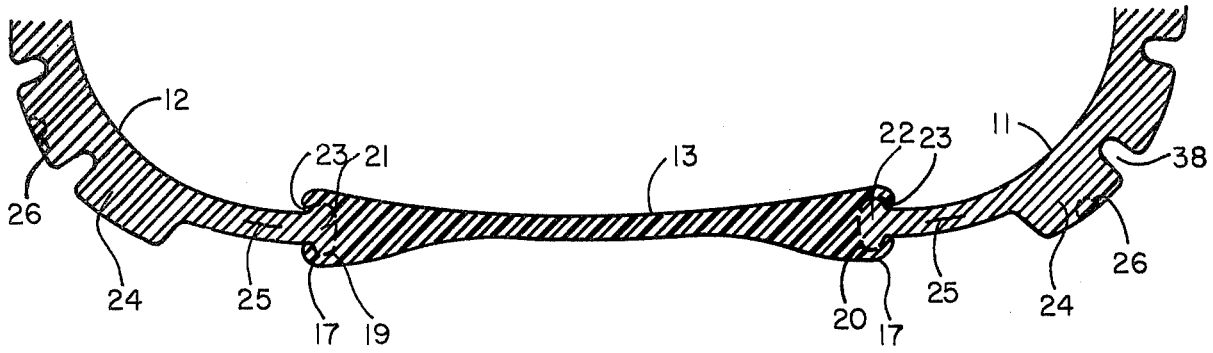
FIG. 3 is a view taken along lines III—III of FIG. 2.

Section 13 is shown in detail in FIGS. 2 and 3. As can be seen in FIG. 3, section 13 preferably has a thickness x of about ¼ inch and, as shown in FIG. 2, a height y of about 2 and ½ inches. Section 13 preferably has a length of about 7 inches. Section 13 is thus generally planar with a slight inward curvature (as can be seen in FIG. 3) to conform to the back of the diver. Section 13 is preferably made of suitable solid material that can flex slightly without breaking and retain its shape, such as nylon or other suitable plastic material. As can be seen in FIG. 3, each end 17,18 of section 13 terminates in a clevis portion 19,20, respectively, for receiving therein a mating dogbone end 21,22 on each section 11,12. A slight gap 23 is provided between each end 21,22 and its mating clevis portion (19 or 20) for reasons to be discussed. As can be seen in FIG. 3, each clevis portion 19,20 is provided in an enlarged end of the section 13.

Sections 11 and 12 are identical, each having a minimum thickness x of about ¼ inch (FIG. 3) and a plurality of weighted sections 24 having lengths 1 of about 1 and ½ inches. Sections 11 and 12 are of a suitable weighted material that is semi-flexible and can retain its shape, such as lead. Since, as will be discussed, sections 11 and 12 will flex in use, reinforcing means 25, such as suitable metallic materials, as steel, may be imbedded in each section 11, 12 adjacent doglegs 21, 22 to strengthen the points or areas of flexation.

As shown particularly in FIG. 1, a plurality of spaced recesses 38, between sections 24, preferably arcuate, are provided on the outer periphery of each section 11, 12. The ends 15, 16 may be beveled, as shown. Space 14 may be a gap of about 2 to 3 inches to allow the diver to move around. The distance from each end 15, 16 to the first adjacent recess 38 is about 3 inches while the distance from doglegs 21, 22 to the first adjacent recess is about 2 inches.

Figure 4:
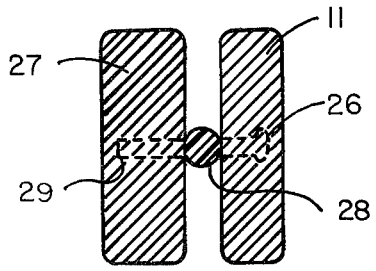
FIG. 4 is a detailed view of a portion of the belt of FIG. 3 taken along lines IV—IV thereof.

Each section 11, 12 may be additionally weighted by providing detachable weights which may also be of lead or other suitable material. For example, weights 27 in FIG. 3 are provided. As shown in FIG. 4, section 11 has a socket or cavity 26 therein for receiving a like configured ball 28 protruding from weight 27. Ball 28 includes an integral shaft 29 imbedded in weight 27. Ball 28, and shaft 29, may be of nylon or the like with weights 27 being of lead. The ball 28 is adapted to snap-fit into socket or cavity 26 and be retained therein. Although any suitable quick release means may be provided, the ball and socket arrangement of FIG. 4 is preferred. In this manner, any desired number of weights 27 may be mounted on sections 11, 12, one per weighted section 24, to vary the overall weight of belt 10.

Recesses 38 may take any suitable configuration to facilitate easy bending, even when there is a large amount of weight on belt 10. The overall length of belt 10 may be any suitable dimensions to accomodate most divers, e.g. 24 to 10 inches long.

Figure 5:
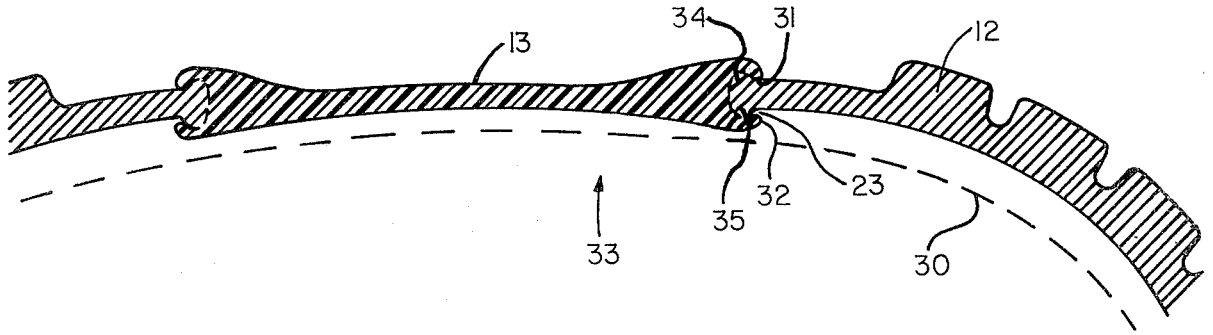
FIG. 5 is a view similar to FIG. 3 illustrating the operation of the belt of FIGS. 1 through 4.

In operation, belt 1- is placed about the waist 36 of the diver as shown in FIG. 1 with section 13 at the back of the diver and space 14 at the front. Suitable weights 27 are added to each section 11, 12 if desired. When it is desired to quickly separate belt 10 from the diver, he inserts fingers 37 (of one hand) in space 14 and pulls one of the sections 11, 12 away from his waist. This is shown in detail in FIG. 5. The dotted line 30 indicates the normal curvature of belt 10 when encircling the waist of the diver. Each clevis portion 19,20 terminates in a first end 31 which is preferably flat and abuts against the outer surface of section 11 or 12 and a second end 32 which is rounded and spaced from section 11 or 12 (to form space 23). When section 12 is pulled away from the body of the diver in the direction of arrow 33, lobe 34 catches on flat end 31 causing lobe 35 to pop out from rounded end 32 thereby seperating section 12 from section 13 and thus releasing belt 10 from the waist of the diver.

It can be seen that there is described a belt which can be secured about the waist of a diver without the need of a fastener, such as a buckle. No buckles, clips, etc, are required other than the weight of the belt itself. There is thus eliminated the possibility of the diver mistaking the weighted belt for other diving gear. No twisting or entangling of gear takes place. Weights may be added or subtracted from belt 10 as required. Under emergency conditions, belt 10 can be quickly and easily seperated at any desired body attitude without entangling tanks or other equipment. By merely pushing inwardly against the sections 11, 12 with his hands, the belt can be tightened. This is important since, as previously discussed, diving suits shrink in size during descent.

The unique means of attaching weights eliminates any possibility of weights shifting position and keeps them as close as possible to the body's center of gravity.

The sections can be coated with closed cell neoprene foam, urethane or epoxy coating, if desired. The various sections can be varied in size and weight so as to accomodate divers of different weights. Plastisols sold by Diamond Shamrock may be used for the lead sections. By forming clevis portions 19,20 internally of section 13, the ends 21,22 are trapped therein and cannot move up and down.

It can be seen that the belt of the invention is easy to use, quickly releasable, results in belt release without danger to accidental release of other equipment, and can be operated with one hand at any body attitude even if the diver is entangled or otherwise engaged.

It is also seen that the device of this invention can be used at various depths of water, for both salt and fresh water, merely by using the belt alone or in combination with the added weights as conditions and the weight of the diver person require. The device lends itself to ease of manufacture in that by proving belts in but a relative few increments of waist line measurements persons of all weights and various diving depth desires, can be easily accomodated.

While one particular mode of providing added weight for the basic belt has been disclosed others are contemplated within the scope of the invention.

It is also to be seen that while centre section 13 has been shown with two clevis portions 19 and 20, it is also within the scope of the invention to provide a belt with but one side either the left or right, quickly releaseable from the rear. Such a construction is shown in FIG. 6.

Figure 6:
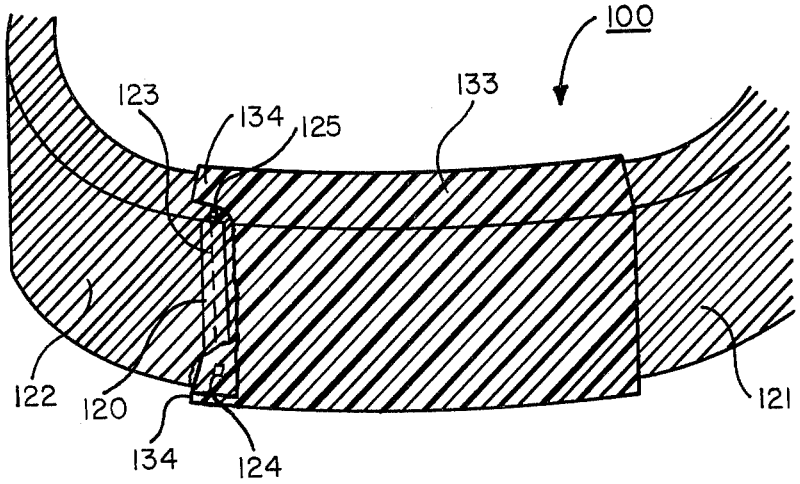
FIG. 6 is a fragmented perspective view of an alternate embodiment of this invention.

FIG. 6 is a perspective view of an alternate embodiment as discussed jut above. Side section 122 terminates in a flat end having a vertical throughbore 120 spaced slightly inward inward from the edge thereof. Spring loaded pin 123 is disposed in said bore for engagement of pin tips 125 in corresponding bores 124 in connecting section 133's outward extending flanges 134. Such attachment mode is common for watchbands. Obviously the dogbone-clevis without the release capability may also be employed. Side 123 is releaseably attached to 133 as 11 is to 13.

Figure 7:
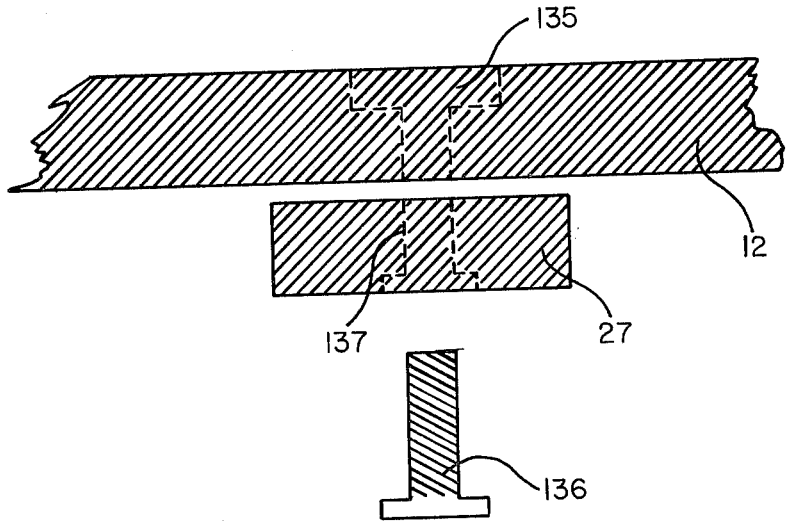
FIG. 7 is a fragmented top plan view illustrating an alternative embodiment of a portion of this invention.

It is also to be seen that among the alternative means of mounting the auxiliary weights would be to countersink and insert to tee-nut 135 into the belt at the appropriate location for the added weight 27, from the body side forward, and to countersink and throughbore 137 the weight 27, such that it could be bolted to the belt by a bolt 136. See FIG. 7, a top plan view illustrating such a weight mounting on to a weighted section 24.

It is seen that one big operating advantage of the instant diver's belt is that it is virtually impossible to twist it prior to putting it on the body due to the nature of its construction.

The divers belts of this invention without additional weights would vary from 10 to about 20 lbs. Added weights of from 30 lbs down to 10 lbs can be provided on the belt. The total weight of a belt with added weights thereon should not preferably exceed 40 lbs. Such a belt would be of a 10 lbs size with 15 lbs of added weights on each body side of the belt. Such belts are believed suitable for divers weighing between 100 and 275 pounds. Divers weighing over about 275 pounds should consult a physician before diving in any event.

Since certain changes may be made in the application herein without department from the scope of the invention, it is intended that all matter contained in the description and drawings shall be interpreted as illustrative and not in a limiting sense. Thus I have described a flexible lead diver's belt having weighted sections separated by recesses, wherein added weights can be secured to each of said weighted sections.

I claim:

1. A quick release diver's belt comprising:

a first weighted arcuate flexible section adapted to partially encircle the waist of a diver, a second weighted arcuate flexible section also adapted to partially encircle the waist of a diver, both of said flexible sections having a plurality of discreted weight segments defined by a plurality of spaced inwardly extending recesses on the outer periphery thereof, a rigid releaseably connected, center section interconnecting one end of one of said flexible sections at each end thereof, the releaseable connections adapted for separation under emergency conditions.

2. In the diver's belt of claim 1 wherein the weight segments are adapted to receive an additional weight for mounting thereon.

3. The diver's belt of claim 2 wherein each flexible weighted section is a one piece unit of lead or other heavy metal.

4. In the belt of claim 1 wherein the free ends of said sections are spaced from each other diametrically opposite said releasable section means.

5. In the belt of claim 4 wherein said free ends are bevelled to facilitate grasping thereof.

6. In the belt of claim 1 wherein each of said sections is coupled to said interconnecting means by a ball and socket.

7. In the belt of claim 6 wherein said ball is on said section and said socket is on said interconnecting means, said ball being generally configured similar to said socket with a space formed between said ball and socket on the interior of said belt.

8. In the belt of claim 7 wherein each of said sections includes an elongated portion terminating in said ball, said socket being generally semi-circular in cross-section forming a generally oval cavity, said socket having spaced ends forming a space receiving said section therein, one of said spaced ends being generally flat and abutting against said elongated portion and the other spaced end being generally round and spaced from said elongated end to form said space, said ball being generally oval and substantially the same configuration as said oval cavity, disposed therein and freely movable therein.

9. In the belt of claim 8 wherein each of said sections is reinforced at said elongated portion adjacent said ball.

10. In the belt of claim 1 wherein said first and second sections are plastic coated.

11. In the belt of claim 2 including releasable and detachable weights releasably engaging at least one of said weighted sections.

12. In the belt of claim 3 wherein each of said weights includes a protruding ball snap adapted to fit into a socket.

13. A quick release diver's belt comprising:

a first arcuate weighted flexible section adapted to partially encircle the waist of a diver; and a second arcuate weighted flexible section adapted to partially encircle the waist of a diver; and rigid releaseable section means interconnecting one end of each of said flexible sections said rigid releaseable section adapted to abut against the back of the wearer;

wherein one of said sections is releaseable coupled to said rigid releaseable section, the other of said sections being hingedly secured to said releaseable section.

14. In the belt of claim 13 including releasable and detachable weights releasably engaging weighted sections of said belt.

15. In the diver's belt of claim 13 wherein the releasable coupling is a lobe on one of said flexible sections and a clevis on said rigid releasable section.

* * * * *